US010271711B2

(12) United States Patent
Jian

(10) Patent No.: US 10,271,711 B2
(45) Date of Patent: Apr. 30, 2019

(54) SHOE SOLE CLEANING APPARATUS

(71) Applicant: Chili Jian, Chengdu (CN)

(72) Inventor: Chili Jian, Chengdu (CN)

( * ) Notice: Subject to any disclaimer, the term of this patent is extended or adjusted under 35 U.S.C. 154(b) by 0 days.

(21) Appl. No.: 15/863,948

(22) Filed: Jan. 7, 2018

(65) Prior Publication Data

US 2018/0125332 A1 May 10, 2018

Related U.S. Application Data

(63) Continuation of application No. PCT/CN2016/089285, filed on Jul. 8, 2016.

(30) Foreign Application Priority Data

Jul. 8, 2015 (CN) ..... 2015 1 0395964

(51) Int. Cl.
*A47L 23/22* (2006.01)
*A47L 23/26* (2006.01)

(52) U.S. Cl.
CPC ..... *A47L 23/263* (2013.01); *A47L 23/22* (2013.01)

(58) Field of Classification Search
CPC ..... A47L 23/263; A47L 23/22
IPC ..... A47L 23/26
See application file for complete search history.

(56) References Cited

U.S. PATENT DOCUMENTS

2014/0331442 A1* 11/2014 Lee ..... A47L 23/263 15/311

FOREIGN PATENT DOCUMENTS

KR 20110043150 A * 4/2011
KR 101502347 B1 * 3/2015 ..... A47L 23/22

* cited by examiner

*Primary Examiner* — David Redding
(74) *Attorney, Agent, or Firm* — Wayne & Ken, LLC; Tony Hom

(57) ABSTRACT

The present disclosure relates to a sole cleaning apparatus, including a pedal having a plurality of vibration sealing column holes provided thereon. Movable vibration sealing columns protrude out from the sealing column holes. Convex pedal ridges are arranged around the sealing column holes, and the vibration sealing columns are higher than the pedal ridges when not pressed down. A vibration sealing chamber leading to a dust collecting and filter chamber is arranged below the vibration sealing column holes, and comprises a step and a spring component. The vibration sealing columns are columns with discs, and the columns vertically penetrate through the vibration sealing chambers and the discs are arranged on the steps. When the vibration sealing columns are pressed down, the vibration sealing columns are in contact with the vibration plates, and vibration generated by the vibration plates is transferred to a sole stepping on the pedal.

5 Claims, 8 Drawing Sheets

SHOE SOLE CLEANING APPARATUS

TECHNICAL FIELD

The disclosure belongs to cleaning field and relates to an apparatus for cleaning shoe soles before people entering into room to avoid shoe soles bring dusts into room.

BACKGROUND

In the field of shoe sole cleaning, the ideal mode is that people stand on an apparatus for about ten seconds to clean the shoe sole including high sole compatibility for the use purpose of safety, convenience, speediness, efficiency, stability, and economic. Searched many methods and modes about the shoe sole cleaning field in the public patents and documents, there is no finding on it. Some patents disclosed self-control sealing technologies like patents as CN203059630U, CN101133933A, CN2925390Y, TWM324491U, CN2274934Y, CN202505308U, CN102488487A, CN102334970A, CN101972132B, and CN2048403U. It is talked about that a platform with many holes is set and a chamber is set as well under the platform. Seal parts like ball, cylinder, and other forms extend out of the holes and press against the holes for seal by elastic parts like springs. Negative press or vacuum is made in the chamber. When shoe soles treaded the seal parts some gaps issue around the seal parts and dusts are take away through the gaps by air flow. When the shoe soles go away from the platform the elastic parts like springs seal the chamber automatically. Because the air flows through the treaded seal parts and not through the other seal parts, the above method is better for flow and energy saving, and also provides possibility for people to clean their shoe sole rapidly by treading on the platform including high soles. It contributes to the convenience and stability as well. However concerned the complex of shoe sole material, shoe sole treading environment, and the dust compositions, especially the adsorption force of the moisture dust is much big to shoe sole, their cleaning efficiency is not good in using. Brushes or column brushes are set in patent CN101133933A and TWM324491U; wiper is set in CN2274934Y and brush mat is set in CN2048403U; they all are for enhance of the cleaning efficiency, but they all are consumable and quick-wear parts and need maintenance, replacement in periodic. This ways would impact to the stability.

SUMMARY

Technical Problem

The disclosure aims to solve the problem of low dust suction effect, enhance the dust suction affect, and keep characteristics of convenience, speediness, reliability and durability based on the current self-control sealing technologies by providing a shoe sole cleaning apparatus.

Solutions

A shoe sole cleaning apparatus includes a control and dust collection group including a power source, a control board, a dust suction blower, a dust filter chamber, and an air heating chamber, which is general technology and not repeated herein and the shoe sole cleaning apparatus also includes a shoe sole cleaning group.

The shoe sole cleaning group is a case, an upper part of the case is a pedal like a platform where people stand; a plurality of vibration sealing column holes are provided on the pedal, movable vibration sealing columns protrude out from the vibration sealing column holes. Raised pedal ridges are provided around each of the vibration sealing column holes. The vibration sealing columns are higher than the pedal ridges when the vibration sealing columns are not treaded; the pedal ridges are embossments from the pedal, both ends of the pedal ridges to the pedal and the top of the pedal ridges to the pedal are gradual slopes. A vibration sealing chamber is arranged under each of the vibration sealing column holes of the pedal and a wear-proof cushion is arranged between the pedal and the vibration sealing chamber as a sealing cushion. The vibration sealing chamber comprises a sealing component in the upper part, a step in the middle part and a spring component in the lower part. A through-hole is arranged at the bottom of the spring component; and the spring component of the vibration sealing chamber is provided with a spring; the vibration sealing chamber is configured to be surrounded by fences or substantial walls. An airflow hole is provided and leading to the dust filter chamber if the vibration sealing chamber is configured to be surrounded by substantial walls. The vibration sealing column is a cylinder with a disk in the middle and a top edge is chamfered; the vibration sealing column is placed in the vibration sealing chamber through the spring and the through-hole of the spring component. The disk of the vibration sealing column blocks the spring and is arranged above the step of the vibration sealing chamber. An upper part of the vibration sealing column protrudes from each of the vibration sealing column holes and up-down movement of the vibration sealing column is limited by the height of the sealing component. A vibration plate is arranged under the vibration sealing chamber, the vibration plate is provided with a vibrator and a vibration absorber. The vibrator generates vibration, and the vibration sealing column delivers the vibration to the shoe sole when the vibration sealing column is treaded to be in contact with the vibration plate; the vibration absorber is the damping material such as spring and is connected to the bottom of the shoe sole cleaning apparatus. The movement of the vibration sealing column is limited by the step of the vibration sealing chamber when the vibration sealing column is treaded; the vibration sealing chamber is connected to the dust filter chamber; a dust suction blower generates negative pressure in the dust filter chamber.

The vibration sealing cap is optional to be equipped on the top of the vibration sealing column and protrudes out from the vibration sealing column hole. The vibration sealing cap and the vibration sealing column can be made as a whole part, or assembled together with two parts.

The disk of the vibration sealing column presses against the sealing cushion under the pedal by the spring in the vibration sealing chamber when the vibration sealing column is not treaded, playing a sealing effect. When a person accesses and treads on the pedal, the dust suction blower starts to work and generate negative pressure. The shoe soles press down the vibration sealing column to be in contact with the pedal ridges, the vibration sealing column moves down under pressure of the shoe sole and the vibration sealing column hole is opened. Due to the suction effect of the dust suction blower, the air flow is formed in the pedal ridges region around the vibration sealing column hole. Pedal ridges are unsealed region, and the air flows freely, so the dust suction blower generates stable air flow. The air flow and the dust flows to the vibration sealing chamber from gaps of the vibration sealing column hole and the vibration sealing column, and to the dust filter chamber.

Finally the dust is collected. The vibration sealing column is moved down to be in contact with the vibration plate, the vibration by the vibrator delivers the vibration sealing column through the vibration plate and then delivers to the shoe soles. The shoe sole is vibrated by the vibrator and the dust is sucked and desiccated by the air flow, the dust is moved away. The shoes move at least one time on the shoe sole cleaning apparatus, the area occupied by pedal ridges is cleaned by the shoe sole cleaning apparatus after movement, playing an effect of cleaning shoe sole.

Beneficial Effects

Vibration apparatus and air flow channel under the shoe sole are arranged based on the self-control sealing technology, when person stands on the apparatus, the dusts under the shoe sole are taken away and cleaned by continuous vibration, stable air flow suction and air flow drying, which has good performance. The arrangement of pedal ridges, and the vibration sealing columns arranged to be same level of the pedal at its lowest position when treaded, these improve the user safety. Also it keeps the characteristics of convenience, speediness, reliability and durability, person can tread freely on the pedals.

Figure 1:
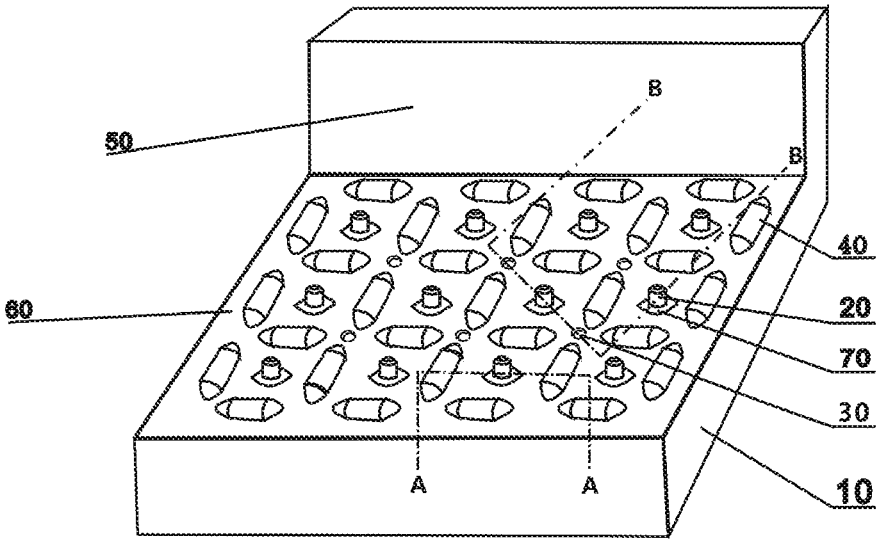
FIG. 1 is a 3D stereoscopic view of a shoe sole cleaning apparatus.
Figure 2:
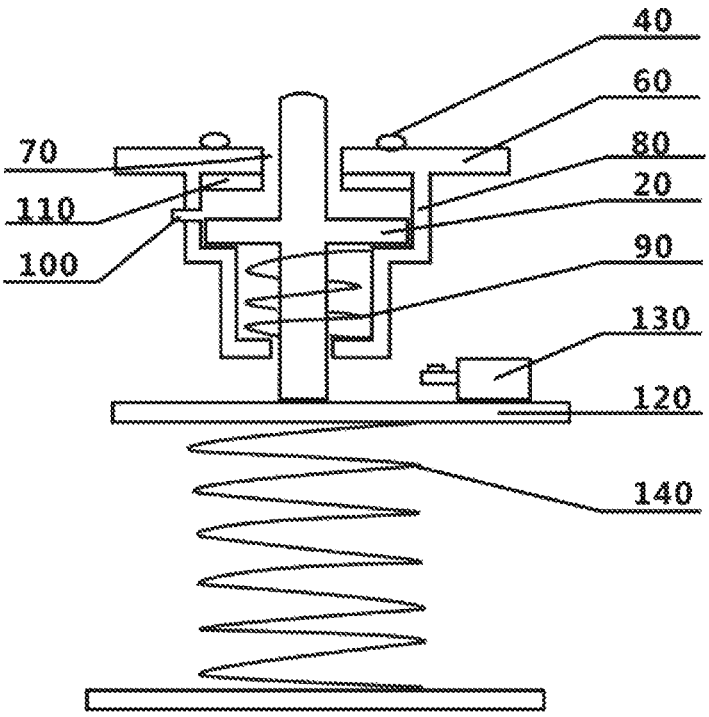
FIG. 2 is a partial section view along line A-A of FIG. 1.
Figure 3:
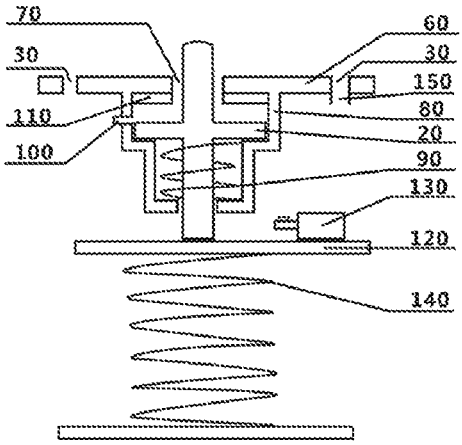
FIG. 3 is a partial section view along line B-B of FIG. 1.
Figure 4:
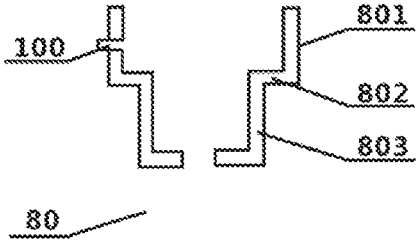
FIG. 4 is a front view of the vibration sealing chamber.
Figure 5:
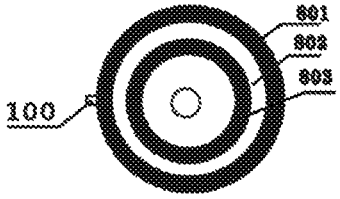
FIG. 5 is a top view of the vibration sealing chamber which wall when surrounded by substantial walls.
Figure 6:
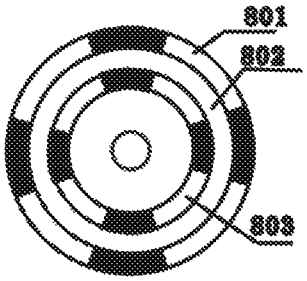
FIG. 6 is a top view of the vibration sealing chamber when surrounded by fence walls.
Figure 7:
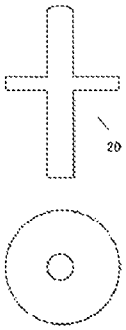
FIG. 7 is a front view and a top view of the vibration sealing column.
Figure 8:
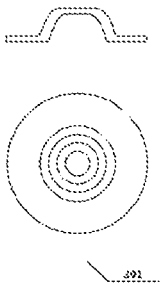
FIG. 8 is a front view and a top view of the vibration sealing cap.

10. shoe sole apparatus, 20. vibration sealing column, 30. air hole, 40. pedal ridge, 50. control and dust collection group, 60. pedal. 70. vibration sealing column hole, 80. vibration sealing chamber, 90. spring, 100. airflow hole, 110. sealing cushion, 120. vibration plate, 130. vibrator, 140. vibration absorber, 150. air interface, 201. vibration sealing cap, 801. sealing component, 802. step, 803. spring component.

DESCRIPTION OF THE PREFERRED EMBODIMENTS

The disclosure is further described in details with reference to figures through embodiments.

The First Embodiment

A shoe sole cleaning apparatus 10 includes a control and dust collection group 50 including a power source, a control board, a dust suction blower, a dust filter chamber, and an air heating chamber, which is general technology and not repeated herein and the shoe sole cleaning apparatus also includes a shoe sole cleaning group.

The shoe sole cleaning group is a case, an upper part of the case is a pedal like a platform 60 where people stand; a plurality of vibration sealing column holes 70 are provided on the pedal, movable vibration sealing columns 20 protrude out from the vibration sealing column holes 70. Raised pedal ridges 40 are provided around each of the vibration sealing column holes 70. The vibration sealing columns 20 are higher than the pedal ridges when the vibration sealing columns 20 are not treaded; the pedal ridges 40 are embossments from the pedal 60, both ends of the pedal ridges to the pedal and the top of the pedal ridges to the pedal are gradual slopes. A cross section of each of the pedal ridges 40 is triangle, circle, semicircle, trapezoid, square or rectangle shaped; and sharp edges of the pedal ridges 40 are chamfered smoothly. A vibration sealing chamber 80 is arranged under each of the vibration sealing column holes 70 of the pedal 60 and a wear-proof cushion is arranged between the pedal 60 and the vibration sealing chamber 80 as a sealing cushion 110. The vibration sealing chamber 80 comprises a sealing component 801 in the upper part, a step 802 in the middle part and a spring component 803 in the lower part. A through-hole is arranged at the bottom of the spring component 803; and the spring component 803 of the vibration sealing chamber 80 is provided with a spring 90; the vibration sealing chamber 80 is configured to be surrounded by fences or substantial walls. An airflow hole 100 is provided and leading to the dust filter chamber if the vibration sealing chamber 80 is configured to be surrounded by substantial walls. The vibration sealing column 20 is a cylinder with a disk in the middle and a top edge is chamfered; the vibration sealing column 20 is placed in the vibration sealing chamber 80 through the spring 90 and the through-hole of the spring component 803. The disk of the vibration sealing column 20 blocks the spring 90 and is arranged above the step 802 of the vibration sealing chamber 80. An upper part of the vibration sealing column 20 protrudes from each of the vibration sealing column holes 70 and up-down movement of the vibration sealing column 20 is limited by the height of the sealing component 801. A vibration plate 120 is arranged under the vibration sealing chamber 80, the vibration plate 120 is provided with a vibrator 130 and a vibration absorber 140. The vibrator 130 is a motor off-center vibrator or a half-wave-transformer vibration generator. The vibrator 130 generated vibration, and the vibration sealing column delivers the vibration to the shoe sole when the vibration sealing column 20 is treaded to be in contact with the vibration plate 120; the vibration absorber 140 is damping material such as spring and is connected to the bottom of the shoe sole cleaning apparatus 10. The movement of the vibration sealing column 20 is limited by the step 802 of the vibration sealing chamber 80 when the vibration sealing column 20 is treaded; the vibration sealing chamber 80 is connected to the dust filter chamber; a dust suction blower generates negative pressure in the dust filter chamber.

The disk of the vibration sealing column 20 presses against the sealing cushion under the pedal 60 by the spring 90 in the vibration sealing chamber 80 when the vibration sealing column is not treaded, playing a sealing effect. When a person accesses and treads on the pedal 60, the dust suction blower starts to work and generate negative pressure. The shoe soles press down the vibration sealing column 20 to be in contact with the pedal ridges 40, the vibration sealing column moves down under pressure of the shoe sole and the vibration sealing column hole 70 is opened. Due to the suction effect of the dust suction blower, the air flow is formed in the pedal ridges 40 region around the vibration sealing column hole 70. Pedal ridges 40 are unsealed region, and the air flows freely, so the dust suction blower generates stable air flow. The air flow and the dust flows to the vibration sealing chamber 80 from gaps of the vibration sealing column hole 70 and the vibration sealing column 20, and to the dust filter chamber. Finally the dust is collected. The vibration sealing column is moved down to be in contact with the vibration plate 120, the vibration by the vibrator delivers the vibration sealing column 20 through the vibration plate 120 and then delivers to the shoe soles. The shoe sole is vibrated by the vibrator and the dust is sucked and desiccated by the air flow, the dust is moved away. The shoes move at least one time on the shoe sole cleaning apparatus 10, the area occupied by pedal ridges 40 is cleaned by the shoe sole cleaning apparatus 10 after movement, playing an effect of cleaning shoe sole.

The Second Embodiment

Air holes 30 are arranged around the pedal ridges 40 on the pedal 60. The vibration sealing chamber 80 surrounded by substantial walls is provided with an airflow hole 100. Air reaches the periphery of the vibration sealing column 20 from air holes 30 through the pedal ridges 40. Other parts refer to the first embodiment. Air holes 30 are added to increase the air flow, strong airflow in the middle of the shoe sole collects dust of the shoe sole. The airflow hole 100 connects the air pipe to the dust filter chamber, which makes the airflow and air pressure of the pedal 60 of the shoe sole cleaning apparatus even and improves cleaning effect.

The Third Embodiment

Air holes 30 are arranged around the pedal ridges 40 on the pedal 60; the air holes 30 are provided with air interfaces 150, and the air interfaces 150 are connected to an air heating chamber through the air pipe; the vibration sealing chamber 80 is surrounded by fences, and airflow leads to the dust filter chamber; or the vibration sealing chamber 80 is surrounded by substantial walls, and the airflow hole 100 is arranged to lead to the dust filter chamber; the airflow hole 100 is connected to the dust filter chamber through the air pipe. This embodiment is suitable for humid area. Air heating chamber provides drying and high temperature airflow, which is good for the cleaning of shoe sole.

The Fourth Embodiment

The vibration sealing cap 201 is equipped on the top of the vibration sealing column 20 and is protruded from the vibration sealing column hole 70; the vibration sealing cap 201 and the vibration sealing column 20 are configured to be made as a whole part, or assembled together with two parts. The vibration sealing cap 201 can match different sizes of the vibration sealing column 20 and the vibration sealing column hole 70.

The Fifth Embodiment

The shapes of the vibration sealing column 20, the vibration sealing column hole 70, and the vibration sealing chamber 80 are matched and coordinated with each other, and the shapes are in various form; and a fence quantity, the fence width, and gaps between the fences of the sealing component 801 and the lower spring component 803 are not limited, meeting engineering needs.

What is claimed is:

1. A shoe sole cleaning apparatus, comprising:

a control and dust collection group; and a shoe sole cleaning group;

wherein the control and dust collection group comprises a power source, a control board, a dust suction blower, a dust filter chamber, and an air heating chamber; the shoe sole cleaning group is a case; a standing platform-like pedal is provided on an upper part of the case; a plurality of vibration sealing column holes are provided on the pedal; movable vibration sealing columns protrude out from the vibration sealing column holes;

raised pedal ridges are provided around each of the vibration sealing column holes;

the vibration sealing columns are higher than the pedal ridges when the vibration sealing columns are not treaded;

the pedal ridges are embossments from the pedal, both ends of the pedal ridges to the pedal and the top of the pedal ridges to the pedal are gradual slopes;

a cross section of the pedal ridges is triangle, circle, semicircle, trapezoid, square or rectangle; and sharp edges of the pedal ridges are chamfered smoothly;

a vibration sealing chamber is arranged under each of the vibration sealing column holes of the pedal and a wear-proof cushion is arranged between the pedal and the vibration sealing chamber as a sealing cushion;

the vibration sealing chamber comprises a sealing component in the upper part, a step in the middle part and a spring component in the lower part;

a through-hole is arranged at the bottom of the spring component; the spring component of the vibration sealing chamber is provided with a spring;

the vibration sealing chamber is configured to be surrounded by fences or substantial walls; an airflow hole is provided and leading to the dust filter chamber if the vibration sealing chamber is configured to be surrounded by substantial walls;

the vibration sealing column is a cylinder with a disk in the middle and a top edge is chamfered;

the vibration sealing column is placed in the vibration sealing chamber through the spring and the through-hole of the spring component;

the disk of the vibration sealing column blocks the spring and is arranged above the step of the vibration sealing chamber;

an upper part of the vibration sealing column protrudes from each of the vibration sealing column holes and up-down movement of the vibration sealing column is limited by the height of the sealing component;

a vibration plate is arranged under the vibration sealing chamber, the vibration plate is provided with a vibrator and a vibration absorber;

the vibrator is a motor off-center vibrator or a half-wave-transformer vibration generator; the vibration sealing column delivers the vibration to the shoe sole when the vibration sealing column is treaded to be in contact with the vibration plate;

the vibration absorber is spring and connected to the bottom of the shoe sole cleaning apparatus; the movement of the vibration sealing column is limited by the step of the vibration sealing chamber when the vibration sealing column is treaded;

the vibration sealing chamber is connected to the dust filter chamber; a dust suction blower generates negative pressure in the dust filter chamber;

the disk of the vibration sealing column presses against the sealing cushion under the pedal by the spring in the vibration sealing chamber when the vibration sealing column is not treaded, playing a sealing effect.

2. The shoe sole cleaning apparatus according to claim 1, wherein air holes are arranged around the pedal ridges on the pedal; the vibration sealing chamber is surrounded by substantial walls and is provided with the airflow hole; the airflow hole is connected to the dust filter chamber through an air pipe.

3. The shoe sole cleaning apparatus according to claim 1, wherein air holes are arranged around the pedal ridges on the pedal; the air holes are provided with air interfaces, and the air interfaces are connected to an air heating chamber through the air pipe; the vibration sealing chamber is surrounded by fences, and airflow leads to the dust filter chamber; or the vibration sealing chamber is surrounded by substantial walls, and the airflow hole is arranged to lead to the dust filter chamber; the airflow hole is connected to the dust filter chamber through the air pipe.

4. The shoe sole cleaning apparatus according to claim 1, wherein a vibration sealing cap is provided on the top of the vibration sealing column and is protruded from the vibration sealing column hole; the vibration sealing cap and the vibration sealing column are configured to be made as a whole part, or assembled together with two parts.

5. The shoe sole cleaning apparatus according to claim 1, wherein shapes of the vibration sealing column, the vibration sealing column hole, and the vibration sealing chamber are matched and coordinated with each other, and the shapes are in various form.

* * * * *